US009526397B2

(12) United States Patent
Kulkarni et al.

(10) Patent No.: US 9,526,397 B2
(45) Date of Patent: Dec. 27, 2016

(54) DISHWASHER DOORS WITH MULTIPLE SILVERWARE BASKETS

(71) Applicant: Whirlpool Corporation, Benton Harbor, MI (US)

(72) Inventors: Dinesh Kulkarni, Pune (IN); Kevin T. Kutto, Pune (IN)

(73) Assignee: Whirlpool Corporation, Benton Harbor, MI (US)

( * ) Notice: Subject to any disclaimer, the term of this patent is extended or adjusted under 35 U.S.C. 154(b) by 0 days.

(21) Appl. No.: 14/837,096

(22) Filed: Aug. 27, 2015

(65) Prior Publication Data

US 2016/0066766 A1 Mar. 10, 2016

Related U.S. Application Data

(60) Provisional application No. 62/047,120, filed on Sep. 8, 2014.

(51) Int. Cl.

| | |
|---|---|
| ***A47L 15/42*** | (2006.01) |
| ***A47L 15/44*** | (2006.01) |
| ***A47L 15/48*** | (2006.01) |
| ***A47L 15/50*** | (2006.01) |

(52) U.S. Cl.

CPC ..... *A47L 15/44* (2013.01); *A47L 15/4246* (2013.01); *A47L 15/4257* (2013.01); *A47L 15/481* (2013.01); *A47L 15/488* (2013.01); *A47L 15/50* (2013.01); *A47L 15/502* (2013.01)

(58) Field of Classification Search

CPC .. A47L 15/4246; A47L 15/4257; A47L 15/44; A47L 15/481; A47L 15/488; A47L 15/50; A47L 15/502

USPC ..... 134/56 D, 57 D, 58 D

See application file for complete search history.

(56) References Cited

U.S. PATENT DOCUMENTS

| | | | | |
|---|---|---|---|---|
| 7,594,513 | B2 | 9/2009 | VanderRoest et al. | |
| 8,349,089 | B2 | 1/2013 | Bertsch et al. | |
| 2005/0045215 | A1 | 3/2005 | Raches et al. | |
| 2008/0289664 | A1* | 11/2008 | Rockwell | A47L 15/421 134/42 |
| 2010/0043852 | A1* | 2/2010 | Classen | A47L 15/4445 134/57 D |

FOREIGN PATENT DOCUMENTS

| | | | |
|---|---|---|---|
| DE | 102009000926 | A1 | 10/2010 |
| EP | 1281346 | A1 | 2/2003 |

* cited by examiner

*Primary Examiner* — Michael Barr
*Assistant Examiner* — Levon J Shahinian

(57) ABSTRACT

Dishwasher doors with multiple silverware baskets are disclosed. A disclosed example dishwasher includes a tub at least partially defining a treating chamber having an opening, a door movably mounted to the tub to selectively open and close the opening, and two or more silverware baskets mounted one above the other on an interior of the door.

20 Claims, 4 Drawing Sheets

DISHWASHER DOORS WITH MULTIPLE SILVERWARE BASKETS

CROSS-REFERENCE TO RELATED APPLICATIONS

The present application claims the benefit of U.S. Provisional Patent Application No. 62/047,120, filed Sep. 8, 2014, which is incorporated by reference herein in their entirety.

FIELD OF THE DISCLOSURE

This disclosure relates generally to dishwashers, and, more particularly, to dishwasher doors with multiple silverware baskets.

BACKGROUND

Conventional dishwashers perform cycles of operation on items present in the dishwasher, and have racks and silverware baskets to hold the items.

SUMMARY

A disclosed example dishwasher includes a tub at least partially defining a treating chamber having an opening, a door movably mounted to the tub to selectively open and close the opening, and two or more silverware baskets mounted one above the other on an interior of the door.

DETAILED DESCRIPTION

In a conventional dishwasher, the upper dish rack is shallower than the lower dish rack because the door of the dishwasher is thicker at the top or middle than at the bottom to accommodate control electronics, exhaust vents, dispensers, etc. Having a thicker door at the middle or top also limits usage of the door to, for example, mount silverware baskets. Accordingly, conventional dishwashers are only able to mount a single silverware basket to the door.

Dishwashers having doors that overcome at least these problems are disclosed herein. By relocating control electronics, exhaust vent, dispenser, etc. from the door to other locations within a dishwasher, the door can be made thinner at the top and middle of the door. For example, a large portion of the door can be thinner and generally flat or flatter, with the top and bottom having thicknesses similar to the bottom. By reclaiming this space on the door, the number of silverware baskets mountable on the door can be increased from the traditional one per door to two, three or more silverware baskets.

Figure 1:
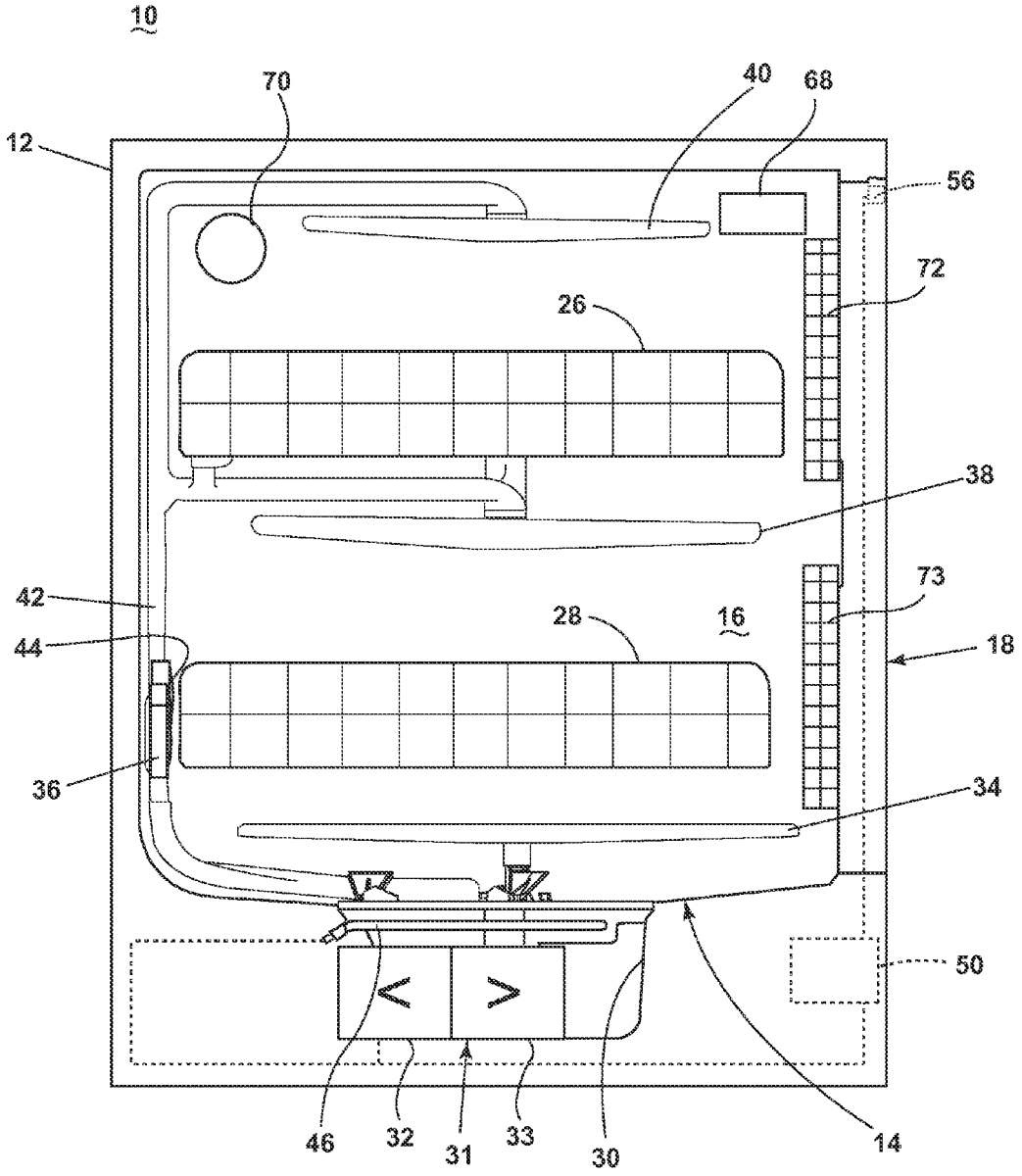
FIG. 1 is a side schematic view of an example dishwasher having a door with multiple silverware baskets constructed in accordance with the teachings of this disclosure.

In FIG. 1, an automated dishwasher 10 according to a first embodiment is illustrated. The dishwasher 10 shares many well known features of a conventional automated dishwasher, which will not be described in detail herein except as necessary for a complete understanding of this disclosure. A chassis 12 defines an interior of the example dishwasher 10 and may include a frame, with or without panels mounted to the frame. An open-faced tub 14 is within the chassis 12 and has a plurality of walls that may at least partially define a treating chamber 16, having an open face access opening, for washing dishes. A door assembly 18 is movably mounted to the dishwasher 10 for movement between opened and closed positions to selectively open and close the open face of the tub 14. Thus, the door assembly 18 provides accessibility to the treating chamber 16 for the loading and unloading of dishes or other washable items.

It should be appreciated that the door assembly 18 may be secured to the lower front edge of the chassis 12 or to the lower front edge of the tub 14 via a hinge assembly (not shown) configured to pivot the door assembly 18. When the door assembly 18 is closed, user access to the treating chamber 16 is prevented, whereas user access to the treating chamber 16 is permitted when the door assembly 18 is open. The door assembly 18 has an inner face that partially forms the treating chamber 16 when the door assembly 18 is in the closed position.

Dish holders, illustrated in the form of upper and lower dish racks 26, 28, are located within the treating chamber 16 and receive dishes for washing. The upper and lower racks 26, 28 are typically mounted for slidable movement in and out of the treating chamber 16 for ease of loading and unloading. Other dish holders may be provided, such as a silverware basket. As used in this description, the term "dish(es)" is intended to be generic to any item, single or plural, that may be treated in the dishwasher 10, including, without limitation, dishes, plates, pots, bowls, pans, glassware, silverware, utensils, any other washable item.

A spray system is provided for spraying liquid in the treating chamber 16 and is provided in the form of a first lower spray assembly 34, a second lower spray assembly 36, a rotating mid-level spray arm assembly 38, and/or an upper spray arm assembly 40. Upper sprayer assembly 40, mid-level rotatable sprayer assembly 38 and lower rotatable sprayer assembly 34 are located, respectively, above the upper rack 26, beneath the upper rack 26, and beneath the lower rack 28 and are illustrated as rotating spray arms. The second lower spray assembly 36 is illustrated as being located adjacent the lower dish rack 28 toward the rear of the treating chamber 16. The second lower spray assembly 36 is illustrated as including a vertically oriented distribution header or spray manifold 44. Such a spray manifold is set forth in detail in U.S. Pat. No. 7,594,513, issued Sep. 29, 2009, and titled "Multiple Wash Zone Dishwasher," which is incorporated herein by reference in its entirety. Alternately, a spray system can provide a dedicated spray assembly for each of the multiple silverware baskets, as is set forth in detail in U.S. Pat. No. 8,349,089, issued Jan. 8, 2013, and titled "Dishwasher Having Dedicated Sprayer for Silverware Basket," which is incorporated herein by reference in its entirety.

A recirculation system is provided for recirculating liquid from the treating chamber 16 to the spray system. The example recirculation system includes a sump 30 and a pump assembly 31. The sump 30 collects the liquid sprayed in the treating chamber 16 and may be formed by a sloped or recess portion of a bottom wall of the tub 14. The pump assembly 31 may include both a drain pump 32 and a recirculation pump 33. The drain pump 32 may draw liquid from the sump 30 and pump the liquid out of the dishwasher 10 to a household drain line (not shown). The recirculation pump 33 may draw liquid from the sump 30 and the liquid may be simultaneously or selectively pumped through a supply tube 42 to each of the sprayer assemblies 34, 36, 38, 40 for selective spraying. While not shown, a liquid supply system may include a water supply conduit coupled with a household water supply for supplying water to the treating chamber 16.

A heating system including a heater 46 may be located within the sump 30 for heating the liquid contained in the sump 30.

A controller 50 is included in the dishwasher 10, which may be operably coupled with various components of the dishwasher 10 to implement a cycle of operation or an automatic cycle of operation. As shown in FIG. 1, the controller 50 may be located below the tub 14, or it may alternatively be located elsewhere within the chassis 12. The controller 50 may also be operably coupled with a control panel or user interface 56 for receiving user-selected inputs and communicating information to the user. The user interface 56 may include operational controls such as dials, lights, switches, and displays enabling a user to input commands, such as a cycle of operation, to the controller 50 and receive information.

Figure 2:
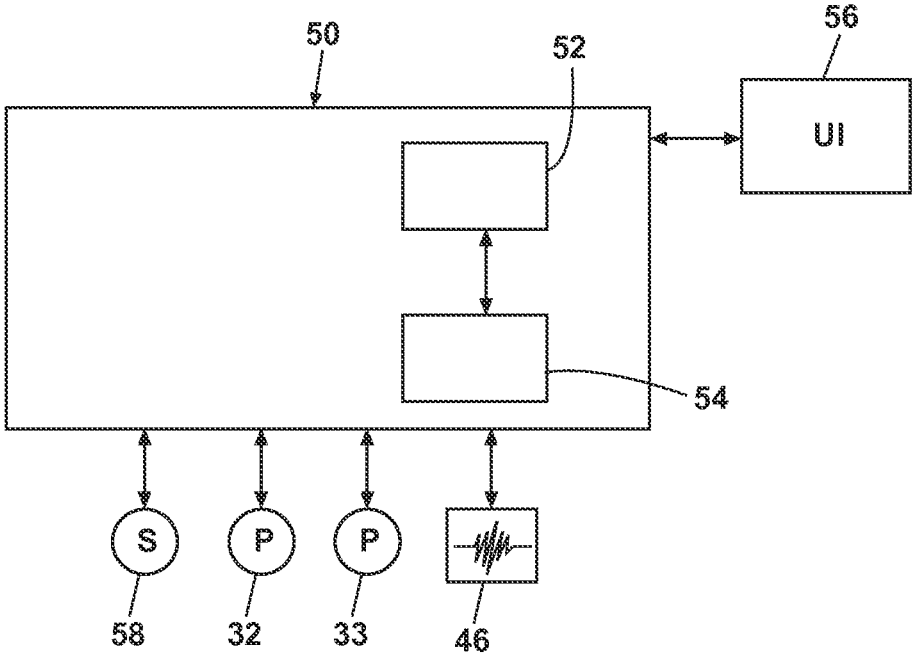
FIG. 2 is a schematic of an example control system for the example dishwasher of FIG. 1.

As illustrated schematically in FIG. 2, the controller 50 may be coupled with the heater 46 for heating the wash liquid during a cycle of operation, the drain pump 32 for draining liquid from the treating chamber 16, and the recirculation pump 33 for recirculating the wash liquid during the cycle of operation. The controller 50 may be provided with a memory 52 and a central processing unit (CPU) or processor 54. The processor 54 can be implemented by, for example, one or more Atmel®, Intel®, AMD®, and/or ARM® microprocessors. Of course, other processors from other processor families and/or manufacturers are also appropriate.

The memory 52 may be used for storing control software that may be executed by the CPU 54 in completing a cycle of operation using the dishwasher 10 and any additional software. For example, the memory 52 may store one or more pre-programmed cycles of operation that may be selected by a user and completed by the dishwasher 10. The memory 52 may include volatile memory such as synchronous dynamic random access memory (SDRAM), a dynamic random access memory (DRAM), RAMBUS® dynamic random access memory (RDRAM) and/or any other type of random access memory (RAM) device(s); and/or non-volatile memory such as flash memory(-ies), or flash memory device(s).

The controller 50 may also receive input from one or more sensors 58. Non-limiting examples of sensors that may be communicably coupled with the controller 50 include a temperature sensor and turbidity sensor to determine the soil load associated with a selected grouping of dishes, such as the dishes associated with a particular area of the treating chamber.

Returning to FIG. 1, the example dishwasher 10 of FIG. 1 includes a dispenser 68 to dispense treating chemistry(-ies) such as detergent, a drying agent, etc. into the treating chamber 16 during a cycle of operation. To vent warm moist air from the treating chamber 16 during a drying cycle of operation, the example dishwasher 10 has an exhaust vent 70. The exhaust vent 70 fluidly couples the treating chamber to an exterior of the dishwasher 10. Traditionally, dispensers and exhaust vents are implemented in the door of a dishwasher. However, in the example dishwasher 10 of FIG. 1, they are implemented, for example, on or at at least one of the plurality of side walls of the tub 14. Alternatively, they could be implemented elsewhere within the dishwasher 10 or chassis 12. The treating chemistry dispenser 68 and the exhaust vent 70 can be located on the same one of the plurality of walls, which can be one of the opposing side walls of the tub 14, or on different ones of the plurality of walls. Accordingly, the space normally required to implement the dispenser 68 and the exhaust vent 70, on the inner face of the door assembly 18, is reclaimed for use in mounting silverware baskets one above the other.

Figure 3:
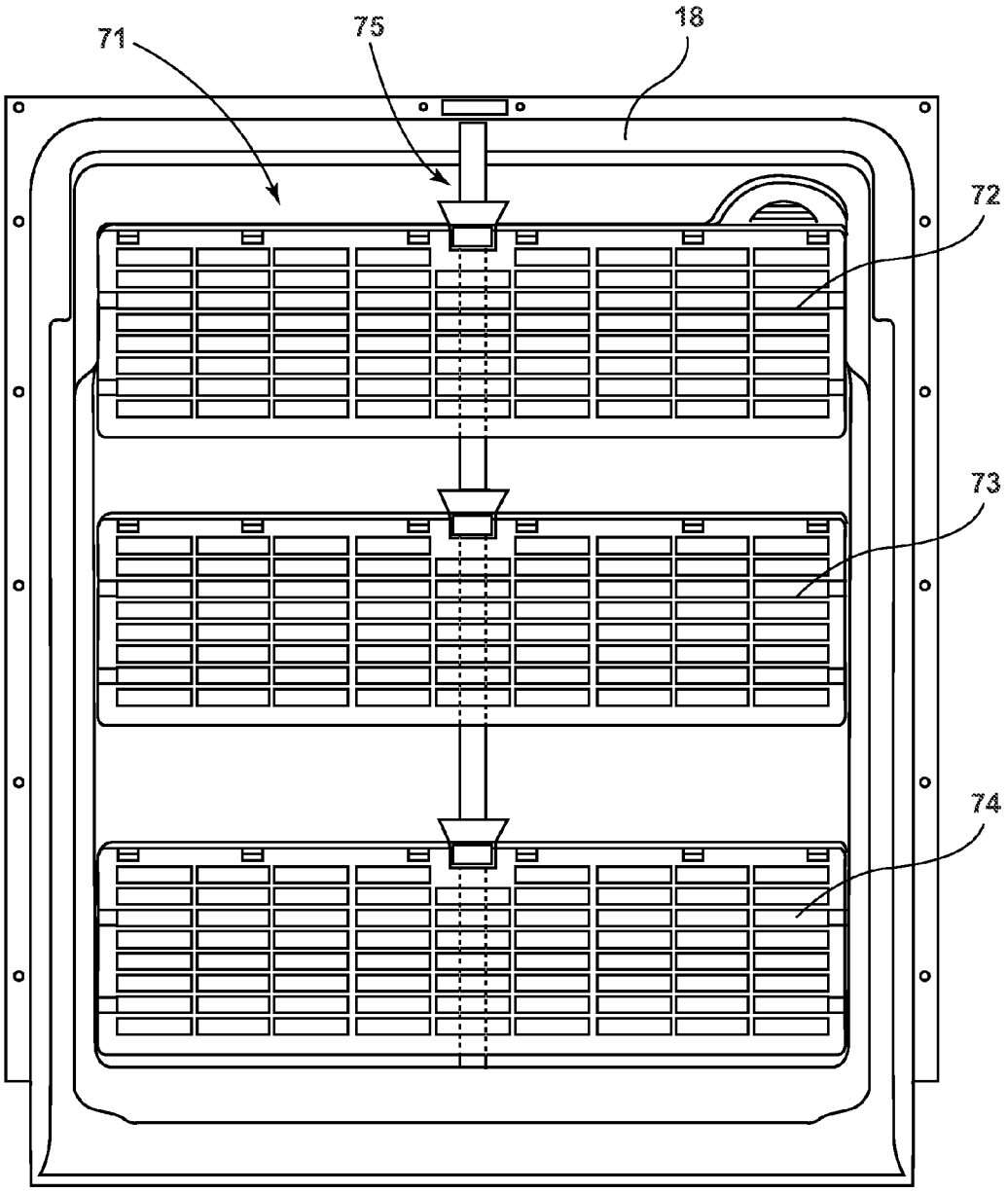
FIG. 3 is a front view of an example manner of implementing the example door of FIG. 1.

As shown in FIGS. 1 and 3, by locating the controller 50, the dispenser 68 and the exhaust vent 70 elsewhere within the dishwasher 10, a large portion 71 of the interior of the door 18 can be made thinner, and generally flat or flatter, such that the door 18 has the same thickness at the portions where the silverware baskets 72, 73, 74 overlie the door 18. It is also contemplated that the portion 71 may be sloped or stepped for other purposes, such mechanical support. By being thinner and flatter, the portion 71 allows multiple silverware baskets to be readily installed, positioned or mounted to the door 18. In the example of FIG. 1 two baskets 72 and 73 are shown, and in the example of FIG. 2 three baskets 72, 73, 74 are shown. However, any number, type(s), size(s) and/or configuration(s) of baskets is contemplated. For example, a taller basket that accommodates long utensils may be mounted beneath a shorter basket. The multiple silverware baskets can be of the same dimensions or different dimensions from one another, having same widths or different widths. Typically, the silverware baskets 72, 73, 74 will be selectively removable and repositionable for user convenience in loading and/or unloading, but may be fixedly mounted. The baskets 72, 73, 74 may be formed of and formed using any number and/or type(s) of materials, methods, etc. For example, they may be formed using injection molding with plastic, formed using coated wire, etc.

Figure 4:
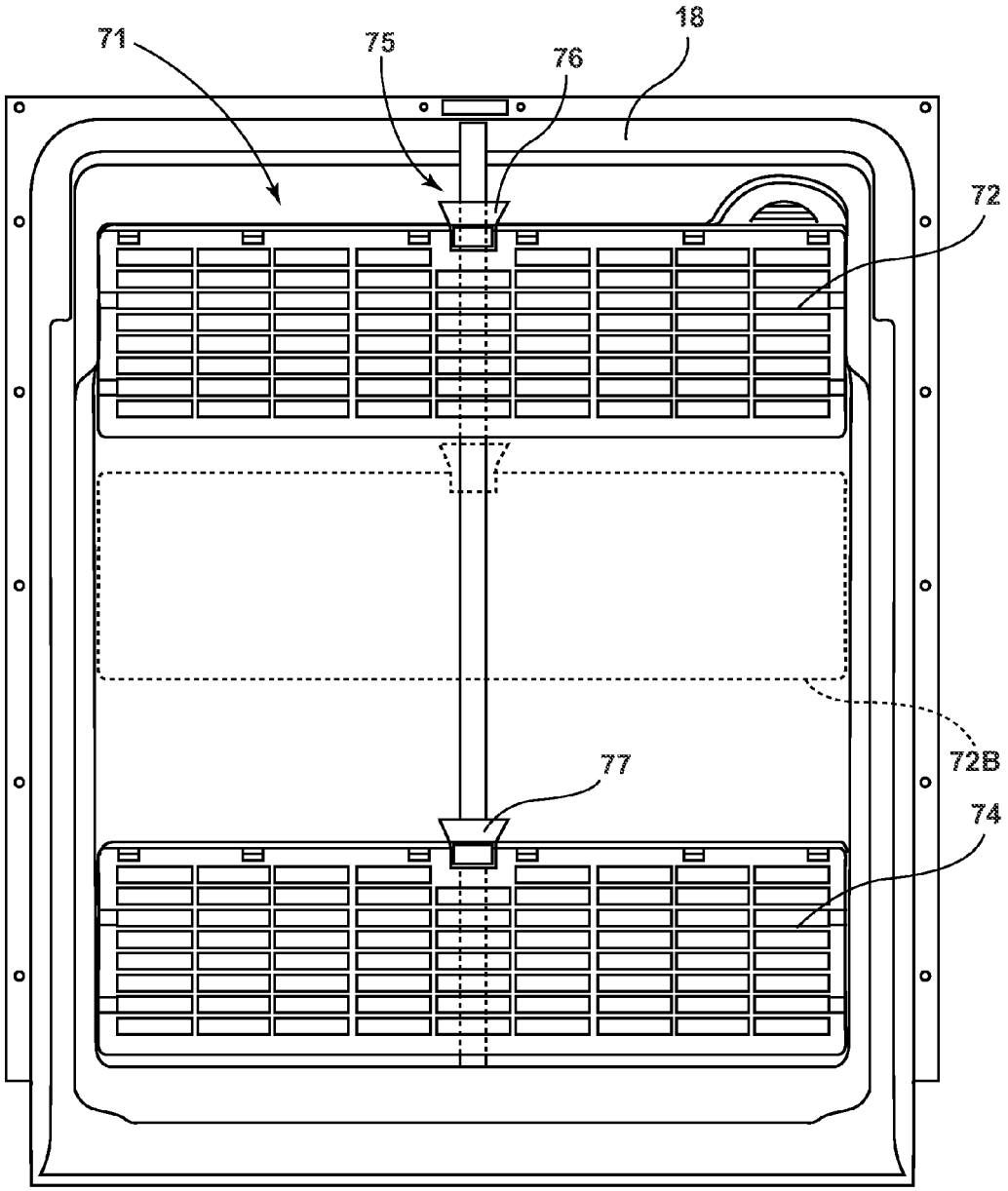
FIG. 4 is a front view of an example manner of implementing the example door of FIG. 1 in which at least one of the multiple silverware baskets is repositionable along the inner surface of the door.

FIG. 4 illustrates an embodiment in which at least one of the multiple silverware baskets 72, 73, 74 is removable and/or repositionable for user convenience. In this example two baskets 72, 74 are shown, but any number of baskets is contemplated. The portion 71 of the inner surface of the door 18 to which the multiple silverware baskets 72, 74 are installed is equipped with a vertically running rail 75 to which the silverware baskets 72, 74 are mountable via the clips 76, 77 located at the upper limit of the rear face of the silverware baskets 72, 74 that allow the baskets to lock in place along the vertical rail 75. The clips 76, 77 allow for the silverware baskets 72, 74 to be removable for loading and unloading of the dishwasher, or when one or more of the baskets 72, 74 are not needed in a particular cycle. Furthermore, the clips 76, 77 allow the user to reposition the silverware baskets 72, 74 as desired at any point along the vertical length of the rail 75. In the example of FIG. 4, basket 74 is shown in a lower position while basket 72 is located above basket 74 at a higher point towards the top of the door 18 along the rail 75. The dotted line 72B indicates an alternate position for basket 72 should the user desire to adjust the height of the basket 72 to allow for utensils of a different height. This allows the user to position the baskets 72, 74 at any combination of relative heights desired, in order to accommodate smaller silverware, as well as taller utensils, such as spatulas, serving spoons, or the like.

It is also contemplated that components may only be removed from a portion of the door 18, and/or that silverware baskets are only mounted on a portion of the door 18. For example, in FIG. 3, the lower and upper left portions of the door 18 could be thin enough to accommodate silverware baskets in those portions, with components such as the dispenser 68 and the exhaust vent 70 positioned in the upper right portion of the door 18. As such, one or more of the silverware baskets 72, 73, 74 need not be as wide as the portion 71.

The embodiments described herein illustrate the advantages of having multiple silverware baskets 72, 73, 74 located on the inner surface of the door 18 over a conventional dishwasher setup. Having multiple silverware baskets 72, 73, 74 increases the overall capacity of the dishwasher for cleaning silverware and other utensils. In addition, it allows the user increased flexibility in attaching the desired number of silverware baskets on a cycle-by-cycle basis and repositioning them to the desired heights to accommodate the different silverwares and utensils that may need to be washed in a given cycle.

In this specification and the appended claims, the singular forms "a," "an," and "the" do not exclude the plural reference unless the context clearly dictates otherwise. Further, conjunctions such as "and," "or," and"and/or" used in this specification and the appended claims are inclusive unless the context clearly dictates otherwise. For example, "A and/or B" includes A alone, B alone, and A with "A or B" includes A with B, and "A and B" includes A alone, and B alone. Further still, connecting lines or connectors shown in the various figures presented are intended to represent example functional relationships and/or physical or logical couplings between the various elements. It should be noted that many alternative or additional functional relationships, physical connections or logical connections may be present in a practical device. Moreover, no item or component is essential to the practice of the embodiments disclosed herein unless the element is specifically described as "essential" or "critical".

Moreover, terms such as, but not limited to, generally, approximately, substantially, etc. are used herein to indicate that a precise value, shape or amount is not required, need not be specified, etc. For example, a first value being approximately a second value means that from a practical implementation perspective they can be considered as if equal. As used herein, such terms will have ready and instant meaning to one of ordinary skill in the art Although certain example methods, apparatus and articles of manufacture have been described herein, the scope of coverage of this patent is not limited thereto. On the contrary, this patent covers all methods, apparatus and articles of manufacture fairly falling within the scope of the claims of this patent.

What is claimed is:

1. A dishwasher comprising:

a tub having a plurality of walls at least partially defining a treating chamber having an access opening;

at least one dish rack mounted within the treating chamber;

a door movably mounted to the tub to selectively open and close the access opening and having an inner surface;

a rail extending vertically along a portion of the inner surface of the door;

multiple silverware baskets located one above another relative to the rail; and a clip repositionably mounting each of the silverware baskets to the rail.

2. The dishwasher as defined in claim 1, wherein a portion of the inner surface of the door on which the silverware baskets are mounted is generally flat.

3. The dishwasher as defined in claim 1, wherein the silverware baskets are identical.

4. The dishwasher as defined in claim 1, wherein the silverware baskets have different heights.

5. The dishwasher as defined in claim 1, wherein the silverware baskets have different widths.

6. The dishwasher as defined in claim 1, wherein the door does not include at least one of a controller, an exhaust vent, and/or a dispenser.

7. The dishwasher as defined in claim 1, wherein each of the silverware baskets have a width substantially corresponding to a width of the door.

8. The dishwasher of claim 1 wherein the door has the same thickness at the portions where the silverware baskets overlie the door.

9. The dishwasher of claim 1 further comprising a controller mounted to the dishwasher at a location other than the door.

10. The dishwasher of claim 1 further comprising a treating chemistry dispenser supplying treating chemistry to the treating chamber and a vent fluidly coupling the treating chamber to an exterior of the dishwasher.

11. The dishwasher of claim 10 wherein both the treating chemistry dispenser and the vent are located on the plurality of walls.

12. The dishwasher of claim 11 wherein the treating chemistry dispenser and the vent are located on the same wall of the plurality of walls.

13. The dishwasher of claim 10 wherein the plurality of walls comprise opposing side walls and at least one of the treating chemistry dispenser and the vent are located on one of the opposing side walls.

14. The dishwasher of claim 13 wherein one of the treating chemistry dispenser and vent are located on one of a plurality of walls other than one of the opposing side walls.

15. The dishwasher of claim 13 wherein both of the treating chemistry dispenser and vent are located on one of the opposing side walls.

16. The dishwasher of claim 15 wherein both of the treating chemistry dispenser and vent are located on the same wall of the opposing side walls.

17. The dishwasher of claim 13 wherein the door has the same thickness at the portions where the silverware baskets overlie the door.

18. The dishwasher of claim 10 wherein at least one of the multiple silverware baskets is vertically repositionable along the inner surface of the door.

19. The dishwasher of claim 18 wherein the plurality of walls comprise opposing side walls and at least one of the treating chemistry dispenser and the vent are located on one of the opposing side walls.

20. The dishwasher of claim 19 wherein the multiple silverware baskets are of the same dimension.

* * * * *